US009456646B2

(12) United States Patent
Calina

(10) Patent No.: US 9,456,646 B2
(45) Date of Patent: Oct. 4, 2016

(54) SYSTEMS AND METHODS FOR EYELASH EXTENSIONS

(71) Applicant: Ize Calina, Westlake Hills, TX (US)

(72) Inventor: Ize Calina, Westlake Hills, TX (US)

( * ) Notice: Subject to any disclaimer, the term of this patent is extended or adjusted under 35 U.S.C. 154(b) by 0 days.

(21) Appl. No.: 14/733,380

(22) Filed: Jun. 8, 2015

(65) Prior Publication Data

US 2015/0359282 A1 Dec. 17, 2015

Related U.S. Application Data

(60) Provisional application No. 62/013,512, filed on Jun. 17, 2014.

(51) Int. Cl.
*A41G 5/02* (2006.01)

(52) U.S. Cl.
CPC ..... *A41G 5/02* (2013.01)

(58) Field of Classification Search
CPC ..... A45D 5/02; A41G 5/02
USPC ..... 132/216, 53
See application file for complete search history.

(56) References Cited

U.S. PATENT DOCUMENTS 8,061,367 B2 11/2011 Rabe et al.
8,113,218 B2 2/2012 Nguyen
8,263,055 B2 9/2012 Do
8,616,223 B2 12/2013 Rabe et al.
2005/0061341 A1 3/2005 Choe
2007/0272264 A1 11/2007 Byrne
2007/0295352 A1* 12/2007 Dinh ..... A41G 5/02 132/200
2007/0295353 A1* 12/2007 Dinh ..... A41G 5/02 132/216
2009/0217939 A1 9/2009 Rabe et al.
2010/0170526 A1* 7/2010 Nguyen ..... A41G 5/02 132/201
2012/0055499 A1* 3/2012 Sanbonmatsu ..... A41G 5/02 132/201
2013/0213427 A1 8/2013 Dinh
2013/0255706 A1* 10/2013 Dinh ..... A41G 5/02 132/53
2014/0026913 A1* 1/2014 Dinh ..... A41G 5/02 132/53
2014/0216488 A1* 8/2014 Dinh ..... A41G 5/02 132/53
2015/0114421 A1* 4/2015 Pham ..... A41G 5/02 132/201
2015/0181967 A1* 7/2015 Dinh ..... A41G 5/02 132/53
2015/0296914 A1* 10/2015 Ngo ..... A41G 5/02 132/201
2016/0037847 A1* 2/2016 Tavakoli ..... B65D 85/70 132/201

* cited by examiner

*Primary Examiner* — Tatiana Nobrega
(74) *Attorney, Agent, or Firm* — Pierson IP, PLLC

(57) ABSTRACT

Embodiments disclosed herein describe systems and methods for applying branched eyelash extensions, wherein two types of eyelash extensions are coupled to the user's natural eyelash. In embodiments, an eyelash extension of a first type may be coupled to a user's natural lash in a first direction, and an eyelash extension of a second type may be coupled to the user's natural lash in a second direction.

9 Claims, 2 Drawing Sheets

115

SYSTEMS AND METHODS FOR EYELASH EXTENSIONS

CROSS-REFERENCE TO RELATED APPLICATIONS

This application claims a benefit of priority under 35 U.S.C. §119 to Provisional Application No. 62/013,512 filed on Jun. 17, 2014, which is fully incorporated herein by reference in its entirety.

BACKGROUND INFORMATION

1. Field of the Disclosure

Examples of the present disclosure are related to systems and methods for eyelash extensions. More particularly, embodiments disclose branched eyelash extensions, wherein two types of eyelash extensions are coupled to an eyelash in different directions.

2. Background

Eyelash extensions are an enhancement designed to add length, thickness, and fullness to natural eyelashes. Currently, there are two types of eyelash extensions, temporary and semi-permanent.

Temporary eyelashes are configured to be worn for short periods of time, and are typically applied with lash glue. Permanent eyelashes are lashes that are configured to be worn for longer periods of times. Generally, when using either temporary or permanent eyelashes, a single synthetic eyelash extension of a standardized length is applied to each natural lash via an adhesive to couple the synthetic lash to the natural lash.

However, applying synthetic eyelash extensions of the same length to a natural lash creates an unrealistic look. Furthermore, overtime natural eyelashes cannot withstand the weight of synthetic eyelashes, and the weight of the synthetic eyelashes may cause tremendous damage to the natural lash, such as thinning and breakage. This damage to the natural lash requires frequent maintenance.

Accordingly, needs exist for more effective and efficient systems and methods to apply eyelash extensions of different weights to a natural lash.

SUMMARY

Embodiments disclosed herein describe systems and methods for applying branched eyelash extensions to a user's natural eyelash, wherein two types of eyelash extensions are coupled to the user's natural eyelash. In embodiments, the positioning of the eyelash extensions may be based on the direction and/or placement of the user's natural eyelash.

In embodiments, an eyelash extension of a first type may be coupled to a user's natural lash in a first direction, and an eyelash extension of a second type may be coupled to the user's natural lash in a second direction. By coupling two types of eyelash extensions to the user's natural lash, the natural lash may be given a softer, more realistic appearance that the user is born with, while also increasing the volume of the user's eyelashes. Furthermore, the two types of eyelash extensions may be applied to the shaft of the user's natural eyelash in opposite direction, wherein each of the types of eyelash extensions may counterbalance the weight of the opposite type of eyelash extension.

In embodiments, the first type of eyelash extensions may be a comprised of synthetic fibers. For example, the first type of eyelash extensions may be polypropylene, poly nylons, and/or advanced polymer synthetics. The second type of eyelash extension may be comprised of an authentic mink material. For example, the second type of eyelash extensions may be mink or faux mink, which may be configured to mimic real mink in appearance and weight.

In embodiments, the first type of eyelash extensions may be thicker in appearance, and weigh more than the second type of eyelash extension. The first type of eyelash extensions may have a diameter that is based on the user's natural lash diameter, wherein the diameter of the first type of eyelash is substantially similar to the user's natural lash diameter. The diameter of the first type of eyelash may be utilized to not damage the user's natural eyelash. Additionally, because the first type of eyelash has a diameter that is substantially similar to the user's natural lash, the first type of eyelash may create a seamless realistic attachment. As the user's natural eyelash grows, the first type of eyelash extension and the user's natural eyelash may remain a unified eyelash. Furthermore, by having the first type of eyelash have the same diameter as the user's natural eyelash may reduce, limit, or prevent twisting, which will limit the damage caused to the user's natural eyelash.

In embodiments, the second type of eyelash extensions may be thinner in appearance and weigh less than the first type of eyelash extension. The second type of eyelash extension may be positioned between one millimeter and eight millimeters away from the user's lash line. The number of second type of eyelash extensions coupled to the user's natural lash may be based on a desired amount of volume. In embodiments, each of the second type of eyelash extensions may be positioned on both sides of the user's natural lash.

In embodiments, the first direction may be a direction from the user's eyelash towards the user's nose, and the second direction may be a direction from the user's eyelash away from the user's nose. By applying a first type of eyelash extension in a first direction and a second type of eyelash extension in a second direction, the volume of the user's eyelash may be increased while maintaining a natural look. Furthermore, by applying the first type of eyelash extension and the second type of eyelash extensions in different directions, the force applied to the natural eyelash may either of the eyelash extensions may be offset by the other type of eyelash extension.

In embodiments, the first and second type of eyelash extensions may be applied on a stem of the user's natural lash, away from the base or eyelid of the user.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1A:
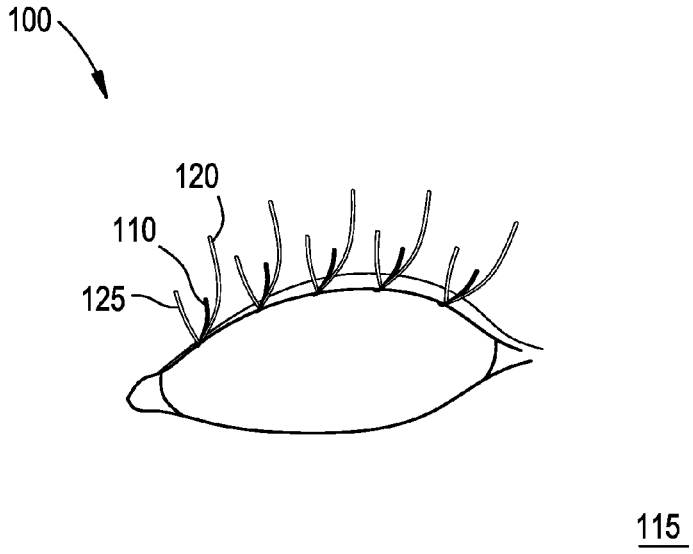
FIGS. 1A and 1B depict a branched eyelash extensions system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods branched eyelash extensions, wherein two types of eyelash extensions are coupled to the user's natural eyelash.

Figure 1B:
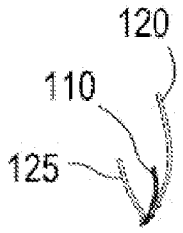

FIGS. 1A and 1B depict one embodiment of branched eyelash extensions system 100. FIG. 1A depicts a Branched eyelash extension system 100 may include a base lash 110, nose 115, first type of eyelash extension 120, and second type of eyelash extension 125. FIG. 1B depicts a branched eyelash extension system where a first type of eyelash extension 120 and second type of eyelash extension 124 are coupled to base lash 110, wherein bash lash 110 is a false eyelash.

Base lash 110 may be a hair that grows at the edge of the eyelid. Base lash 110 may be may be configured to protect a user's eye from debris and clear dust off the user's eye. Base lash 110 may be configured to be grown out of a lash line on the user's eyelid, wherein the lash line is the initial exposed portion of the base lash 110 disposed outside of the eyelid. Having long, full natural eyelashes is considered a sign of beauty in many cultures. Therefore, users may utilize eyelash extensions of different types 120, 125 to increase the length and volume of the appearance of base lash 110. In embodiments, base lash 110 may be the user's natural eyelash, a false eyelash, etc.

First type of eyelash extension 120 may be a synthetic eyelash. The synthetic eyelash may be comprised of various synthetic fibers that are configured to be soft and flexible, wherein the synthetic fiber is able to be curled. The synthetic eyelash may have a first weight and a first length. The synthetic eyelash may be configured to be positioned at a first height away from the lash line, and the synthetic eyelash may be configured to be positioned at a first direction away from base lash 110.

Second type of eyelash extension 125 may be a mink eyelash. The mink eyelash may be comprised of various mink fibers. The mink eyelash may have second weight and a second length. The mink eyelash may be configured to be positioned at a second height away from the lash line, and the synthetic eyelash may be configured to be positioned at a second direction away from natural eyelash. In embodiments, the second weight may be greater than the first weight.

First type of eyelash extension 120 and second type of eyelash extension 125 may be configured to be coupled to base lash 110 in a plurality of different manners. One example manner may be lash glue which is designed specifically to secure an eyelash extension 120, 125 to base lash 110. In embodiments, a first end of eyelash extensions 120, 125 may be configured to be positioned adjacent to base lash 110, and a second end of eyelash extensions 120, 125 may extend vertically past the tip of base lash 110.

In embodiments, the first height associated with first type of eyelash extension 120 may be positioned away from the lash line, and may be different from the second height. In embodiments, the first height may be greater than the second height. For example, the first height may be 1 mm away from the lash line and the second height may be 2 mm away from the lash line. First type of eyelash extension 120 may be positioned away from the lash line at the first height, which is shorter than the second height, to compensate for the difference in weight between the first type of eyelash extension 120 and second type of eyelash extension 125. Thus, the further away from the lash line an eyelash extension 120, 125 is positioned, the greater force eyelash extension 120, 125 may have on base lash 110. Accordingly, first type of eyelash extension 120 with a greater weight than second type of eyelash extension 125 may be positioned closer to the lash line, such that the force on base lash 110 caused by eyelash extensions 120, 125 may be approximately equal.

In embodiments, the first direction associated with first type of eyelash extension 120 may be different than the second direction associated with the second type of eyelash extension 125. The first direction may be towards the axis of symmetry of a user's face and the second direction may be away from the axis of symmetry of the user's face. The first type of eyelash extension 120 and second type of eyelash extension 125 may be positioned in different directions to counteract the weight of each other, wherein base lash 110 and eyelash extensions 120, 125 may be combined to have a natural, full looking appearance.

Furthermore, the first direction associated with first type of eyelash extension 120 or the second direction of second type of eyelash extension 125 may be based on the curve and/or direction of base lash 110, wherein if the curve and/or direction of base lash 110 is towards the axis of symmetry, then the first direction may be towards the axis of symmetry. If the curve and/or direction of base lash 110 is away from the axis of symmetry, then the second direction may be away from the axis of symmetry.

One skilled in the art will appreciate that a user may have a plurality of different eyelashes, and each eyelash may have different orientation of positioning and/or direction of the first type of eyelash extension 120 and the second type of eyelash extension 125.

In embodiments, the first type of eyelash extension 120 and the second type of eyelash extension 125 may be utilized to correct a base lash 110. For example, if first base lash 110 is growing in a direction that is angled or bent away from the user's nose and away from the rest of the base lashes, a first type of eyelash extension may be positioned on the inner side of the base lash 110 and a second type of eyelash may be positioned on the outer side of the base lash. Therefore, based on the differences in weights between the first type of eyelash extensions 120 and the second type of eyelash extension 125, the direction of growing of base lash 110 may be changed.

However, in another embodiment where base lash 110 is growing in a direction that is angled or bent towards the user's nose and away from the rest of the base lashes, a first type of eyelash extension may be positioned on the outer side of the base lash, and a second type of eyelash may be positioned on the inner side of the base lash 110.

Figure 2:
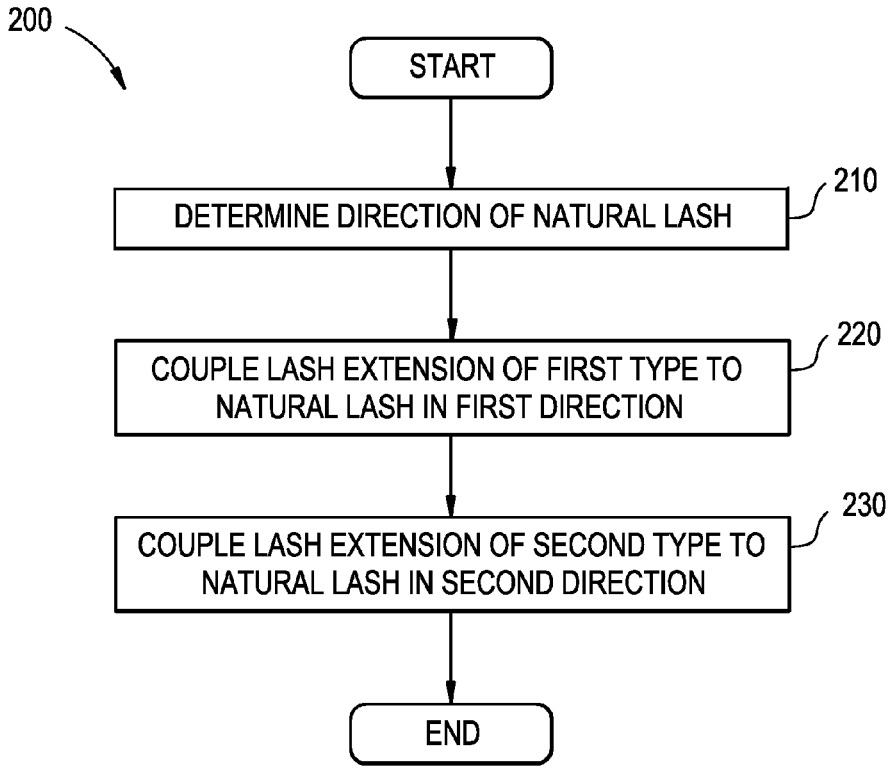
FIG. 2 depicts a method for a branched eyelash extensions system, according to an embodiment.

FIG. 2 depicts a method 200 for a branched eyelash extensions system, according to an embodiment. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting.

At operation 210, a direction that a natural eyelash protrudes from a lash line may be determined. The direction that the natural eyelash protrudes may be determined based on an adjacent, second natural eyelash. If the natural eyelash protrudes in the same direction as the second natural eyelash, then it may be determined that the eyelash is protruding in a natural direction.

At operation 220, responsive to determining that the eyelash is protruding in a natural direction, a first type of eyelash extension may be coupled to the natural lash. The first type of eyelash extension may be coupled to the natural eyelash at a first height and in a first direction, wherein the first direction is positioned from the natural lash towards the axis of symmetry of the user's face.

At operation 230, responsive to coupling the first type of eyelash extension to the natural lash at the first height and in the second direction, a second type of eyelash extension may be coupled to the natural lash. The second type of eyelash extension may be coupled to the natural lash at a second height and in a second direction. The second height may be a greater distance away from the lash line as the first height, and the second direction may be an opposite direction as the first direction, wherein the second direction is positioned from the natural lash away from the axis of symmetry of the user's face.

Operations 220 and 230 may be repeated for a plurality of different natural lashes on a user's lash, wherein different natural lashes may receive different amounts of first type of eyelash extensions or second type of eyelash extensions. For example, a natural lash may be coupled to one first type of eyelash extension and two second types of eyelash extensions, wherein each of the first type and second type of eyelash extensions coupled to a natural lash are positioned in the first direction and second direction, respectively.

In embodiments, a first types of eyelash extensions and second types of eyelash extensions may be coupled to a base lash.

An embodiment may include a synthetic eyelash extension being placed on right side of natural lash slightly away from the nose about 1 mm from lash line. Additionally, An embodiment may include a mink eyelash extension being placed about 2 mm away from lash line on left side of natural lash at an upright position, slightly away or slightly toward the nose.

An embodiment may include a synthetic eyelash extension being placed on right side of natural lash slightly away from the nose about 1 mm from lash line. An embodiment may include two Mink eyelash extension being placed about 2 mm away from lash line on left side of natural lash at an upright position, away from nose or slightly toward the nose.

An embodiment may include a synthetic eyelash extension being placed on right side of natural lash slightly away from the nose about 1 mm from lash line. An embodiment may include two Mink eyelash extension being placed about 2 mm away from lash line on left side of natural lash at an upright position, slightly away from nose or slightly toward the nose and one mink eyelash extension slightly higher than two on right side of natural lash either away from nose/toward nose or at an upright position.

An embodiment may include a synthetic eyelash extension being placed on left side of natural lash slightly away from the nose about 1 mm from lash line. An embodiment may include a mink eyelash extension being placed about 2 mm away from lash line on right side of natural lash at an upright position, slightly away or slightly toward the nose.

An embodiment may include a synthetic eyelash extension being placed on left side of natural lash slightly away from the nose about 1 mm from lash line. An embodiment may include two mink eyelash extension being placed about 2 mm away from lash line on right side of natural lash at an upright position, away from nose or slightly toward the nose.

An embodiment may include a synthetic eyelash extension being placed on left side of natural lash slightly away from the nose about 1 mm from lash line. An embodiment may include a mink eyelash extension being placed about 2 mm away from lash line on right side of natural lash at an upright position, slightly away from nose or slightly toward the nose and one mink eyelash extension slightly higher than two on left side of natural lash either away from nose/toward nose or at an upright position.

An embodiment may include a synthetic eyelash extension being placed on bottom of natural lash slightly away from the nose about 1 mm from lash line. Mink eyelash extension is placed about 2 mm away from lash line on right side of natural lash at an upright position, slightly away or slightly toward the nose.

An embodiment may include a synthetic eyelash extension being placed on bottom of natural lash slightly away from the nose about 1 mm from lash line. An embodiment may include two mink eyelash extension being placed about 2 mm away from lash line on right side of natural lash at an upright position, away from nose or slightly toward the nose.

An embodiment may include a synthetic eyelash extension being placed on bottom of natural lash slightly away from the nose about 1 mm from lash line. An embodiment may include two mink eyelash extension being placed about 2 mm away from lash line on right side of natural lash at an upright position, slightly away from nose or slightly toward the nose and one mink eyelash extension slightly higher than two on left side of natural lash either away from nose/toward nose or at an upright position.

An embodiment may include a synthetic eyelash extension being placed on bottom of natural lash slightly away from the nose about 1 mm from lash line. An embodiment may include a mink eyelash extension being placed about 2 mm away from lash line on left side of natural lash at an upright position, slightly away or slightly toward the nose.

An embodiment may include a synthetic eyelash extension being placed on bottom of natural lash slightly away from the nose about 1 mm from lash line. An embodiment may include a two mink eyelash extensions being placed about 2 mm away from lash line on left side of natural lash at an upright position, away from nose or slightly toward the nose.

An embodiment may include a synthetic eyelash extension being placed on bottom of natural lash slightly away from the nose about 1 mm from lash line. An embodiment may include two Mink eyelash extension being placed about 2 mm away from lash line on left side of natural lash at an upright position, slightly away from nose or slightly toward the nose and one mink eyelash extension slightly higher than two on right side of natural lash either away from nose/toward nose or at an upright position.

An embodiment may include a synthetic eyelash extension being placed on top of natural lash slightly away from the nose about 1 mm from lash line. An embodiment may include a mink eyelash extension being placed about 2 mm away from lash line on right side of natural lash at an upright position, slightly away or slightly toward the nose.

An embodiment may include a synthetic eyelash extension being placed on top of natural lash slightly away from the nose about 1 mm from lash line. An embodiment may include two Mink eyelash extension being placed about 2 mm away from lash line on right side of natural lash at an upright position, away from nose or slightly toward the nose.

An embodiment may include a synthetic eyelash extension being placed on top of natural lash slightly away from the nose about 1 mm from lash line. An embodiment may include two mink eyelash extension being placed about 2 mm away from lash line on right side of natural lash at an upright position, slightly away from nose or slightly toward the nose and one mink eyelash extension slightly higher than two on left side of natural lash either away from nose/toward nose or at an upright position.

An embodiment may include a synthetic eyelash extension being placed on top of natural lash slightly away from the nose about 1 mm from lash line. An embodiment may include a mink eyelash extension being placed about 2 mm away from lash line on left side of natural lash at an upright position, slightly away or slightly toward the nose.

An embodiment may include a synthetic eyelash extension being placed on bottom of natural lash slightly away from the nose about 1 mm from lash line. An embodiment may include two mink eyelash extension being placed about 2 mm away from lash line on left side of natural lash at an upright position, away from nose or slightly toward the nose.

An embodiment may include a synthetic eyelash extension being placed on bottom of natural lash slightly away from the nose about 1 mm from lash line. An embodiment may include two mink eyelash extension being placed about 2 mm away from lash line on left side of natural lash at an upright position, slightly away from nose or slightly toward the nose and one mink eyelash extension slightly higher than two on right side of natural lash either away from nose/toward nose or at an upright position.

An embodiment may include correcting a natural lash growing about 2-6 mm away from and bent from the rest of natural lashes going away from the nose. The synthetic eyelash extension is placed on a left side of natural lash slightly toward nose about 1 mm from lash line. An embodiment may include a mink eyelash extension being placed about 2 mm away from lash line on right side of natural lash at an upright position, slightly away or slightly toward the nose.

An embodiment may include correcting a natural lash growing about 2-6 mm away from the rest of the natural lashes going away from the nose. An embodiment may include placing synthetic eyelash extensions on the left side of natural lash, slightly toward a user's nose about 1 mm from lash line. FIG. 9B also depicts two mink eyelash extensions being placed about 2 mm away from lash line on right side of natural lash at an upright position, slightly away or slightly toward the nose.

An embodiment may include correcting a natural lash growing about 2-6 mm away from the rest of the natural lashes going away from the nose. An embodiment may include placing synthetic eyelash extensions on the left side of natural lash, slightly toward nose about 1 mm from lash line. An embodiment may include mink eyelash extensions being placed about 2 mm away from lash line on right side of natural lash at an upright position, slightly away or slightly toward the nose. Also, one mink eyelash extension may be placed on the left side of natural lash at an upright position, slightly away or slightly toward the nose.

An embodiment may include correcting a natural lash growing about 2-6 mm away from the rest of the natural lashes going toward nose. An embodiment may include placing a synthetic eyelash extension on right side of the natural lash, slightly away from the nose about 1 mm from lash line. Additionally, a mink eyelash extension is placed about 2 mm away from lash line on left side of natural lash at an upright position, slightly away or slightly toward the nose.

An embodiment may include correcting a natural lash growing about 2-6 mm away from the rest of natural lashes going toward nose. An embodiment may include placing a synthetic eyelash extension on the right side of natural lash, slightly away from the nose about 1 mm from lash line. Additionally, An embodiment may include two mink eyelash extensions being placed about 2 mm away from lash line on left side of natural lash at an upright position, slightly away or slightly toward the nose.

An embodiment may include correcting a natural lash growing about 2-6 mm away from the rest of natural lashes going toward nose. An embodiment may include placing a synthetic eyelash extension on right side of natural lash, slightly away from the nose about 1 mm from lash line. Additionally, An embodiment may include placing two mink eyelash extensions about 2 mm away from lash line on left side of natural lash at an upright position, slightly away or slightly toward the nose. Also, An embodiment may include one mink eyelash extension being placed on right side of natural lash at an upright position, slightly away or slightly toward the nose.

In embodiments, first type of eyelash extension 120 or second type of eyelash extension 125 may be coupled to the end of a natural eyelash. By coupling the eyelash extensions to the tip of natural lash 110, an extra volume look may be created.

An embodiment may include a first type of eyelash extension 120 may be coupled to a first side of a natural lash 110, and a second type of eyelash extension may be coupled to a second side of natural lash 110. Utilizing branched eyelash system 120, an appearance that a user has more lashes on their bottom eyelashes may be created. In embodiments, first type of eyelash extensions 120 and second type of eyelash extensions 125 may be used to prevent extensions from getting intertwined with the user's top lashes.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention.

Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A branched eyelash extension system comprising:

a base lash that is configured to project away from a face of a user, the base lash configured to project either towards or away from a nose of the user, wherein the base lash is a false eyelash;

a first type of eyelash extension comprised of synthetic fibers having a first diameter, a first length and a first weight, a first end of the first type of eyelash extension being coupled to the base lash in a first direction, the first type of eyelash extension being coupled to the base lash at a first height;

a second type of eyelash extension comprised of a mink material having a second diameter, a second length and a second weight, a first end of the second type of eyelash extension being coupled to the base lash in a second direction, wherein the first direction and the second direction are positioned on opposite sides of the base lash, and the second type of eyelash extension is coupled to the base lash at a second height, wherein the first height and the second height are different heights, the first height being closer to a lash line end of the base lash than the second height.

2. The system of claim 1, wherein a force applied to the base lash from the first type of eyelash extension is similar to the force applied to the base lash from the second type of eyelash extension based on the first height, second height, first weight, and second weight.

3. The system of claim 2, wherein the first type of eyelash extension has the same diameter as the base lash, and the second type of eyelash extension has a different diameter than the first type of eyelash extension and the base lash.

4. The system of claim 3, wherein the first direction is positioned towards an axis of symmetry of the user's face, and the second direction is positioned away from the axis of symmetry of the user's face.

5. The system of 4, further comprising:

a plurality of second type of eyelash extensions independently coupled to the base lash.

6. The system of claim 5, wherein each of the plurality of second type of eyelash extensions is positioned on the same side of the base lash.

7. The system of claim 5, wherein a first set of the plurality of second type of eyelash extensions are positioned on a first side of the base lash, and a second set of the plurality of second type of eyelash extensions are positioned on a second side of the base lash.

8. The system of claim 5, wherein a first of the plurality of second type of eyelash extensions is positioned above the first type of eyelash extension, and a second of the plurality of second type of eyelash extensions is positioned below the first type of eyelash extensions.

9. The system of claim 1, wherein the base lash is a synthetic eyelash that is configured to mimic a natural eyelash in shape and size.

* * * * *